US010689920B1

(12) United States Patent
Burrows

(10) Patent No.: US 10,689,920 B1
(45) Date of Patent: Jun. 23, 2020

(54) WELLHEAD INTERNAL LATCH RING APPARATUS, SYSTEM AND METHOD

(71) Applicant: Downing Wellhead Equipment, LLC, Oklahoma City, OK (US)

(72) Inventor: Steven Kim Burrows, Oklahoma City, OK (US)

(73) Assignee: Downing Wellhead Equipment, LLC, Oklahoma City, OK (US)

( * ) Notice: Subject to any disclaimer, the term of this patent is extended or adjusted under 35 U.S.C. 154(b) by 0 days.

(21) Appl. No.: 16/005,528

(22) Filed: Jun. 11, 2018

Related U.S. Application Data

(60) Provisional application No. 62/518,377, filed on Jun. 12, 2017.

(51) Int. Cl.
*E21B 17/08* (2006.01)
*E21B 17/06* (2006.01)
*E21B 17/042* (2006.01)

(52) U.S. Cl.
CPC ..... *E21B 17/08* (2013.01); *E21B 17/042* (2013.01); *E21B 17/06* (2013.01)

(58) Field of Classification Search
CPC ..... E21B 17/06; E21B 33/04; E21B 33/043
See application file for complete search history.

(56) References Cited

U.S. PATENT DOCUMENTS 2,644,524 A * 7/1953 Baker ..... E21B 17/06 285/34
2,737,248 A * 3/1956 Baker ..... E21B 17/043 285/34
2,778,430 A * 1/1957 Baker ..... E21B 33/1291 166/139
3,398,795 A * 8/1968 Elliston ..... E21B 17/06 166/120
4,355,825 A * 10/1982 Leicht ..... E21B 33/043 166/115
4,416,472 A * 11/1983 Fowler ..... E21B 33/043 166/217

(Continued)

FOREIGN PATENT DOCUMENTS

GB 2431185 A * 6/2005 ..... E21B 33/038

*Primary Examiner* — James G Sayre
*Assistant Examiner* — Aaron L Lembo
(74) *Attorney, Agent, or Firm* — Frederic Dorwart, Lawyers PLLC; Penina Michlin Chiu

(57) ABSTRACT

A wellhead internal latch ring apparatus, system and method is described. An internal latch ring includes a running tool brace portion, a load retention portion below the brace portion and extending outward from the brace portion, a plurality of slots dispersed around the load retention portion, each slot extending axially through at least a portion of the load retention portion, and a circumferential groove extending around an inner diameter of the load retention portion. A wellhead latch ring method includes compressing an array of elasticizing slots dispersed around a latch ring during lowering of the latch ring into position within a wellhead, aligning the compressed slots with an internal wellhead groove, removing the compression on the slots to engage the latch ring into the internal wellhead groove, and guiding debris out of the internal wellhead groove through the array of elasticizing slots as the latch ring is engaged.

7 Claims, 9 Drawing Sheets

(56) References Cited

U.S. PATENT DOCUMENTS 4,482,014 A * 11/1984 Allwin ..... E21B 17/06 166/136
4,773,477 A * 9/1988 Putch ..... E21B 23/02 166/206
4,903,992 A * 2/1990 Jennings ..... E21B 17/06 285/123.4
4,948,925 A * 8/1990 Winters ..... E21B 7/062 166/113
5,149,143 A * 9/1992 Howell ..... E21B 33/03 285/18
5,413,171 A * 5/1995 Womack ..... E21B 31/18 166/98
5,984,008 A * 11/1999 Lang ..... E21B 33/04 166/208
7,040,407 B2 * 5/2006 Jennings ..... E21B 33/043 166/348
7,428,927 B2 * 9/2008 Vert ..... E21B 7/20 166/285
7,441,594 B2 * 10/2008 Vanderford ..... E21B 33/04 166/368
D607,547 S * 1/2010 Maier ..... D23/262
8,613,324 B2 * 12/2013 Nguyen ..... E21B 33/04 166/208
8,636,072 B2 * 1/2014 Gette ..... E21B 33/04 166/341
8,757,671 B2 * 6/2014 Pallini, Jr. ..... E21B 17/043 285/322
9,169,710 B2 * 10/2015 Jahnke ..... E21B 33/038
9,376,881 B2 * 6/2016 Gette ..... E21B 33/0422
9,598,928 B2 * 3/2017 Thornburrow ..... E21B 33/14
9,797,214 B2 * 10/2017 Gadre ..... E21B 33/03
10,018,008 B2 * 7/2018 Cain ..... E21B 19/00
10,392,883 B2 * 8/2019 Thornburrow ..... E21B 33/0415
2013/0068466 A1 * 3/2013 Ghumre ..... E21B 33/043 166/348

* cited by examiner

WELLHEAD INTERNAL LATCH RING APPARATUS, SYSTEM AND METHOD

CROSS REFERENCE TO RELATED APPLICATIONS

This application claims the benefit of U.S. Provisional Application No. 62/518,377 to Burrows, filed Jun. 12, 2017 and entitled "WELLHEAD INTERNAL LATCH RING," which is hereby incorporated by reference in its entirety.

BACKGROUND OF THE INVENTION

1. Field of the Invention

Embodiments of the invention described herein pertain to the field of wellhead equipment for oil and gas wells. More particularly, but not by way of limitation, one or more embodiments of the invention enable a wellhead internal latch ring apparatus, system and method.

2. Description of the Related Art

In oil and gas wells, a wellhead is the component at the surface of the well that provides the structural and pressure handling interface for drilling and production equipment. The wellhead provides the suspension point and pressure seals for the casing string that runs from the bottom of the hole to surface pressure control equipment.

Various types of casing suspension components and associated seal assemblies have been devised for suspending casing and sealing a casing annulus within a wellhead housing. These casing suspension components and seal assemblies involve positioning a casing hanger within the wellhead housing, and using a running tool to deliver the seal assembly carried on the casing hanger, thereby sealing the casing hanger within the bore of the wellhead housing.

For various reasons, a casing hanger within the wellhead may move axially upward. Such upward axial translation may be a result of pressure acting on the sealing mechanisms, or when the wellhead is part of a production system, downhole fluids at elevated temperatures thermally expand the casing string and thus exert a substantial upward force on the casing hanger. Since the casing hanger seal is intended for sealing at a particularly prepared location within the wellhead, upward movement of the casing hanger and the seal assembly is detrimental to reliably sealing the casing annulus.

Conventionally, radially arrayed pins or lockdown screws are employed to hold the casing hanger axially in place. The pins and lock screws penetrate the wellhead housing wall to engage the internal sealing and suspension components, thereby preventing axial movement of the components. However, a problem that arises with the pin or lock screw approach is that multiple leak paths form due to the plurality of lock screws and associated penetrations required. This can undesirably compromise the wellhead integrity and cause undesirable pressure leak paths.

It has also been proposed to employ locking rings to prevent axial movement of the casing hanger and seal support. The locking ring is conventionally a thin, steel alloy ring that is collapsed by a running tool, and then allowed to expand into a groove in the wellhead housing. The groove in the wellhead housing is positioned over a shoulder on the seal support or packoff. When in place, the locking ring acts to block upward motion of the seal support and casing hanger.

A problem that arises with conventional locking rings is that in order for the steel locking ring to suitably expand and contract for insertion and removal, the locking ring must be thin in order to remain sufficiently elastic. A suitably thin locking ring does not provide adequate support against the upward pressure experienced by the casing hanger, potentially leading to failure of the locking ring and dislodgment of the casing hanger. It is possible to use more expensive material for the lock ring, such as titanium, but this significantly increases the cost of the wellhead components, which is undesirable.

Another problem that arises with conventional locking rings is that during drilling operations, debris such as drilling mud accumulates in the wellhead housing. The debris accumulates inside the locking ring and can interfere with the ability of the locking ring to collapse for removal. An inability to remove the locking ring can interfere with replacement of failing seal supports, which can be detrimental to successful well operation.

As is apparent from the above, current approaches to securing a casing hanger and seal support in position within a wellhead suffer from many drawbacks. Therefore, there is a need for an improved wellhead internal latch ring apparatus, system and method.

BRIEF SUMMARY OF THE INVENTION

One or more embodiments of the invention enable a wellhead internal latch ring apparatus, system and method.

A wellhead internal latch ring apparatus, system and method is described. An illustrative embodiment of an improved wellhead internal latch ring includes an annular running tool brace portion, an annular load retention portion coupled below the annular running tool brace portion, the annular load retention portion stepped outward from a bottom of the annular running tool brace portion, and a plurality of slots dispersed around the load retention portion, each slot of the plurality of slots extending axially through at least a portion of the annular load retention portion. In some embodiments, the improved wellhead internal latch ring further includes a circumferential groove extending around an inner diameter of the annular load retention portion, the circumferential groove fluidly coupled to the plurality of slots. In certain embodiments, the circumferential groove forms a curved relief and intersects the plurality of slots. In some embodiments, the plurality of slots form a plurality of pathways between an outer diameter of the annular load retention portion and the inner diameter of the annular load retention portion. In certain embodiments, the annular load retention portion is mechanically actuatable between a compressed position and a relaxed position. In some embodiments, each slot of the plurality of slots extends axially from a bottom of the annular load retention portion, through the annular load retention portion and at least partially into the running tool brace portion. In certain embodiments, the annular load retention portion and the running tool brace portion include a ring shape with open ends. In some embodiments, the plurality of slots include an elasticizing array spaced around the load retention portion from end-to-end.

An illustrative embodiment of a wellhead system includes a wellhead including at least one internal wellhead groove, a latch ring configured to engage into each of the at least one the internal wellhead grooves, each latch ring including a split forming a pair of open ends, a plurality of axial slots dispersed around the latch ring between the pair of open ends, each axial slot of the plurality of axial slots fluidly coupling an outside of the latch ring and an inside of the latch ring, and a circumferential ring groove around the inside of the latch ring, the circumferential ring groove fluidly coupling each axial slot of the plurality of axial slots to one of an adjacent axial slot, an end of the pair of open ends, or a combination thereof. In some embodiments, when engaged into the at least one wellhead internal groove, the latch ring carries axial thrust of at least one wellhead component. In certain embodiments, one of the at least one wellhead internal groove extends circumferentially around an inner diameter of a casing head, and the at least one wellhead component includes a seal support, the at least one wellhead internal groove extends circumferentially around an inner diameter of the seal support, and the at least one wellhead component includes a packoff, or a first wellhead internal groove of the at least one wellhead internal grooves extends circumferentially around the inner diameter of the casing head and a first wellhead component of the at least one wellhead components includes the seal support, and a second wellhead internal groove of the at least one wellhead internal grooves extends circumferentially around the inner diameter of the seal support and a second wellhead component of the at least one wellhead components includes the packoff. In some embodiments, the at least one wellhead component includes a shoulder configured to align with one of the at least one wellhead internal grooves, the shoulder seating the latch ring when the latch ring is compressed. In certain embodiments, each latch ring further including a brace portion and a load retention portion, wherein the load retention portion is configured to expand outward into one of the at least one internal wellhead grooves to engage the latch ring, and wherein the plurality of axial slots extend axially across the load retention portion. In some embodiments, the circumferential groove extends around an inner diameter of the load retention portion and forms a curved cavity on an inner diameter of the load retention portion. In certain embodiments, each latch ring is configured to be compressed by a running tool engaging the brace portion.

An illustrative embodiment of a wellhead includes a seal support engaged within a casing head, the seal support including a shoulder around an outer diameter of the seal support, the casing head having an internal casing groove extending around an inner diameter of the casing head opposite the shoulder of the seal support, and a latch ring seated on the shoulder and engaged within the internal casing groove, the latch ring including an elasticizing array of axial slots spaced around the latch ring, and a relief groove extending circumferentially around an inner diameter of the latch ring, the relief groove intersecting each slot of the elasticizing array of axial slots. In some embodiments, the relief groove defines an inner diameter of a load retention portion of the latch ring. In certain embodiments, the load retention portion of the latch ring engages within the internal casing groove. In some embodiments, the latch ring includes a brace portion coupled to the load retention portion, the brace portion extending above the internal casing groove when the latch ring is engaged. In certain embodiments, the ring groove and the elasticizing array of axial slots together form a debris displacement pathway.

An illustrative embodiment of a wellhead latch ring method includes compressing an array of elasticizing slots dispersed around a latch ring during lowering of the latch ring into position within a wellhead, aligning the compressed array of elasticizing slots with an internal wellhead groove, removing the compression on the array of elasticizing slots to engage the latch ring into the internal wellhead groove, and guiding debris inwardly and out of the internal wellhead groove through the array of elasticizing slots as the latch ring is engaged. In some embodiments, debris is further guided inwardly out of the internal wellhead groove through a ring groove around an inner diameter of the latch ring, the ring groove intersecting the array of elasticizing slots to form pathways for debris removal.

In further embodiments, features from specific embodiments may be combined with features from other embodiments. For example, features from one embodiment may be combined with features from any of the other embodiments. In further embodiments, additional features may be added to the specific embodiments described herein.

BRIEF DESCRIPTION OF THE DRAWINGS

The above and other aspects, features and advantages of illustrative embodiments of the invention will be more apparent from the following more particular description thereof, presented in conjunction with the following drawings wherein.

Figure 1:
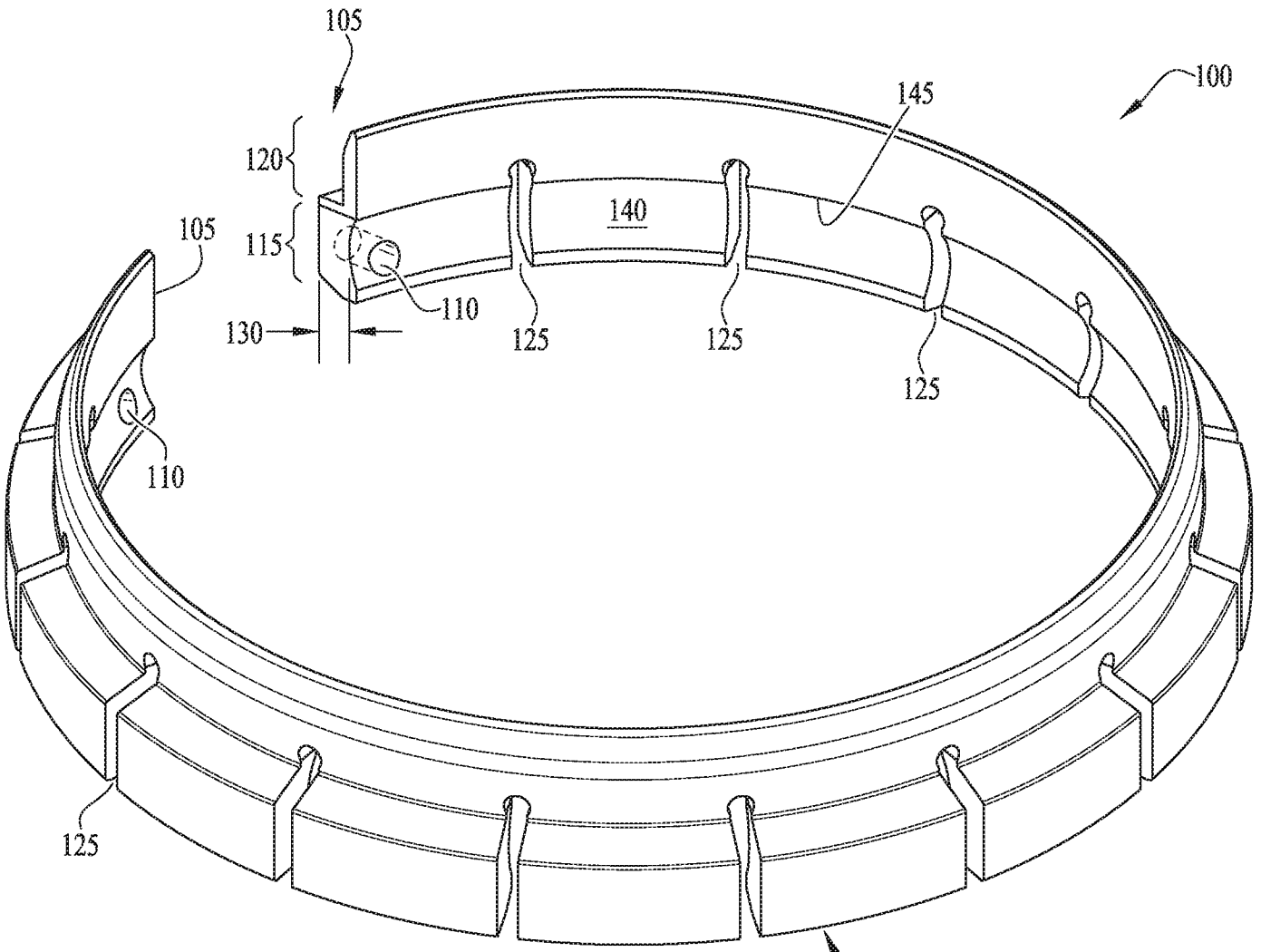
FIG. 1 is a perspective view of a latch ring of an illustrative embodiment.

While the invention is susceptible to various modifications and alternative forms, specific embodiments thereof are shown by way of example in the drawings and may herein be described in detail. The drawings may not be to scale. It should be understood, however, that the embodiments described herein and shown in the drawings are not intended to limit the invention to the particular form disclosed, but on the contrary, the intention is to cover all modifications, equivalents and alternatives to such embodiments that fall within the scope of the present invention as defined by the appended claims.

DETAILED DESCRIPTION

A wellhead internal latch ring apparatus, system and method will now be described. In the following exemplary description, numerous specific details are set forth in order to provide a more thorough understanding of embodiments of the invention. It will be apparent, however, to an artisan of ordinary skill that the present invention may be practiced without incorporating all aspects of the specific details described herein. In other instances, specific features, quantities, or measurements well known to those of ordinary skill in the art have not been described in detail so as not to obscure the invention. Readers should note that although examples of the invention are set forth herein, the claims, and the full scope of any equivalents, are what define the metes and bounds of the invention.

As used in this specification and the appended claims, the singular forms "a", "an" and "the" include plural referents unless the context clearly dictates otherwise. Thus, for example, reference to a latch ring includes one or more latch rings.

"Coupled" refers to either a direct connection or an indirect connection (e.g., at least one intervening connection) between one or more objects or components. The phrase "directly attached" means a direct connection between objects or components.

In the art, "outer diameter" and "outer circumference" are sometimes used equivalently. As used herein, the outer diameter is used to describe what might otherwise be called the outer circumference and/or outer surface of a tubular or annular component, such as the outer surface of a latch ring or a seal support.

In the art, "inner diameter" and "inner circumference" are sometimes used equivalently. As used herein, the inner diameter is used to describe what might otherwise be called the inner circumference and/or inner surface of a tubular or annular component, such as the inner surface of a latch ring or a casing head.

For ease of description and so as not to obscure the invention, illustrative embodiments are described in terms of oil and gas wellhead systems having multi-bowl casing heads. However, illustrative embodiments are not so limited and may be employed in any wellhead where a hanger, packoff, seal support and/or another similar component may benefit from axial thrust protection.

A latch ring of illustrative embodiments may include an array of elasticizing axial slots circumferentially dispersed around the latch ring, and a debris displacing relief groove extending around an inner diameter of the latch ring. The array of axial slots and/or relief groove may improve the elasticity of the latch ring and/or reduce stiffness, and the improved elasticity may allow the axial load retention section of the latch ring to be formed with an increased thickness that may correspondingly increase the thrust handling capability of the latch ring of illustrative embodiments. The increased strength and elasticity of illustrative embodiments may allow less expensive materials to be used in making the latch ring of illustrative embodiments, such as alloy steel rather than titanium. The relief groove and/or axial slots may provide pathways that encourage removal of debris that tends to accumulate inside the wellhead internal groove that mates with the latch ring. The debris displacement pathways may improve ease of installation and/or removal of the latch ring of illustrative embodiments despite the presence of drilling mud in the wellhead.

Illustrative embodiments may maximize axial forces that may be applied to and/or carried by an internal latch ring of illustrative embodiments, thereby maximizing the allowable potential pressure below the seal support and packoff of the wellhead in which one or more latch rings of illustrative embodiments may be employed. In one example, the maximum working pressure of the upper stage zone of the wellhead may be 10,000 psig, and coupling that pressure with the maximum possible sealed area resulting from installation of a back pressure valve, the axial force may be 1.4 million pounds. During testing, the inventor has observed that a latch ring of illustrative embodiments achieved a 1.3 million pound force. Thus illustrative embodiments have been experimentally shown to retain over 90% of the maximum possible load, which represents a significant improvement over conventional locking rings and exceeds the requirements of most, if not all, field applications since the concurrent presence of 10,000 psig below the seal systems and a fully blanked pressure retaining area, although theoretically possible, is unlikely.

The success of the latch ring of illustrative embodiments has been contrary to expectations of those of skill in the art since removal of material from the latch ring to create slots and/or a relief groove reduces the bearing area and would therefore be expected to reduce the loads capable of being carried by the latch ring of illustrative embodiments. Contrary to expectations, the inventor has observed that a latch ring of illustrative embodiments handles greater loads because the increase in cross sectional area of available thrust carrying portions of the latch ring outweighs the detrimental effects of removal of bearing material.

FIG. 1 illustrates a latch ring of an illustrative embodiment. Latch ring 100 may be annular and/or ring-shaped forming a circle and/or portion of a circle with two open ends 105. An aperture 110 may be placed proximate each end 105 for installation of pins of a compression tool onto latch ring 100. Latch ring 100 may include two portions, a lower axial load section 115 and an upper running tool brace section 120. The axial load section 115 may extend from the bottom of the running tool brace section 120. The outer diameter of the running tool brace section 120 may be smaller than the outer diameter of axial load section 115, such that the outer diameter of axial load section 115 steps outward from running tool brace portion 120. Axial load section 115 may be thicker in cross section thickness 130 than running tool brace portion 120, and increased cross section thickness 130 of axial load section 115 may improve the thrust and/or axial load handling capability of latch ring 100. In an exemplary non-limiting embodiment, cross sectional thickness 130 of thrust carrying portions of latch ring 100 may for example be 20%, 30%, up to 50%, or another similar dimension, thicker than a comparable conventional locking ring.

Running tool brace portion 120 may form a bracing surface for a running tool 500 (shown in FIG. 5) to grasp and compress latch ring 100 during installation and removal of latch ring 100 from a wellhead seal assembly. Axial load section 115 may sit on a shoulder of packoff 400 (shown in FIG. 4) and expand into a recess of a seal support 300 (shown in FIG. 3) when latch ring 100 is expanded and/or may sit on a shoulder of a seal support 300 and extend into recess of a casing head 550 (shown in FIG. 5) when latch ring 100 is expanded. The inner diameter of latch ring 100 may be sized to fit around a seal support assembly and/or packoff assembly and may for example be about 11 inches in diameter, about 14.5 inches in diameter or another similar dimension depending on the size and type of wellhead.

Latch ring 100 may include an array, set and/or series of slots 125. Slots 125 may be spaced circumferentially around latch ring 100 between ends 105. Spacing of slots 125 may be at even intervals, such as every half inch, every inch, every two inches, or may be spaced at varying intervals around latch ring 100. Slots 125 may extend entirely through cross sectional thickness 130 traversing between the inner diameter and outer diameter of latch ring 100. Slots 125 may extend axially upward from bottom 135 of latch ring 100, through axial load retention section 115 and may also extend partially into running tool brace portion 120. Axial slots 125 may simplify and/or control installation of lock ring 100 by utilizing the stored elastic energy of the inwardly, radially compressed latch ring 100 itself to effect the expansion of latch ring 100 when it is released by the running tool 500 used to install latch ring 100. Slots 125 may control the compression and/or expansion of latch ring 100 and/or permit sizing the latch ring 100 for higher axial loads while simultaneously maintaining the requisite elastic flexural capability.

Relief groove 140 may extend circumferentially around the inner diameter of axial load retention section 115 of latch ring 100. One or more grooves 140 may extend circumferentially around latch ring 100 from first end 105 to second end 105 and/or between first end 105 and second end 105. Groove 140 may extend in height from bottom 135 of latch ring 100 to intersection 145 between axial load retention section 115 and running tool brace section 120. In some embodiments, one or more relief grooves 140 may extend partially and/or entirely between bottom 135 of latch ring 100 and intersection 145. Groove 140 may be a curved relief inside latch ring 100 and/or axial load retention section 115 that may provide additional flexibility in addition to slots 125 and/or may provide a cavity for accumulation of debris if latch ring 100 must be collapsed and retrieved after the initial installation. Groove 140 may contribute to the flexibility of latch ring 100 and the ability of latch ring 100 to be repeatedly installed and removed without excess plastic deformation and/or groove 140 may provide a void for debris accumulation in the instance latch ring 100 is removed after installation. Groove 140 may be a shallow, curved channel around latch ring 100 that serves to guide fluid and/or debris flowing inwardly through slots 125 such that debris is removed from areas where debris may otherwise prevent compression of latch ring 100 and/or full engagement of latch ring 100 within internal wellhead recess 510 (shown in FIG. 5). In some embodiments, groove 140 may include multiple curved interior reliefs and/or scallops. Groove 140 and/or slots 125 may provide flexibility to latch ring 100 and/or multiple pathways whereby debris may be displaced inwardly during ring installation, allowing complete engagement and/or disengagement of latch ring 100 into or out of the wellhead housing, casing head and/or seal support recess in which it may be installed or removed.

Latch ring 100 may be made of alloy steel or stainless steel and machined from tubing of the appropriate material. To form latch ring 100, latch ring 100 may be removed from a lathe as a solid ring and then slots 125 and/or groove 140 may be milled. Latch ring 100 may be coated over the steel substrate to enhance corrosion resistance and decrease contact friction in service.

Latch ring 100 may be employed as a wellhead internal latch ring, for example in a multi-bowl or multi-stage wellhead system. The wellhead of illustrative embodiments may be manufactured to American Petroleum Institute (API) specifications, such as in one example API specification 6A. An exemplary wellhead may include a seal assembly for sealing a casing annulus in the wellhead. The wellhead housing may include a radial internal wellhead groove 510 and/or recess extending circumferentially around an inner diameter of the wellhead casing head 550 or seal support 300. The casing hanger and seal assembly may be positioned within the wellhead by deployment with running tool 500. Latch ring 100 may be expandable and/or relaxable into the internal recess in the wellhead to axially connect the seal assembly and the wellhead and to provide a barrier to upward movement of the seal assembly. Rotationally actuating the running tool 500 may permit latch ring 100 to expand into the recess in the wellhead housing and thereby connect the seal assembly to both the wellhead and the hanger. Full engagement of latch ring 100 into its respective wellhead housing recess may be critical to proper functioning of latch ring 100. Illustrative embodiments may provide for the displacement of debris in the wellhead housing recess to achieve full engagement of latch ring 100.

Figure 2B:
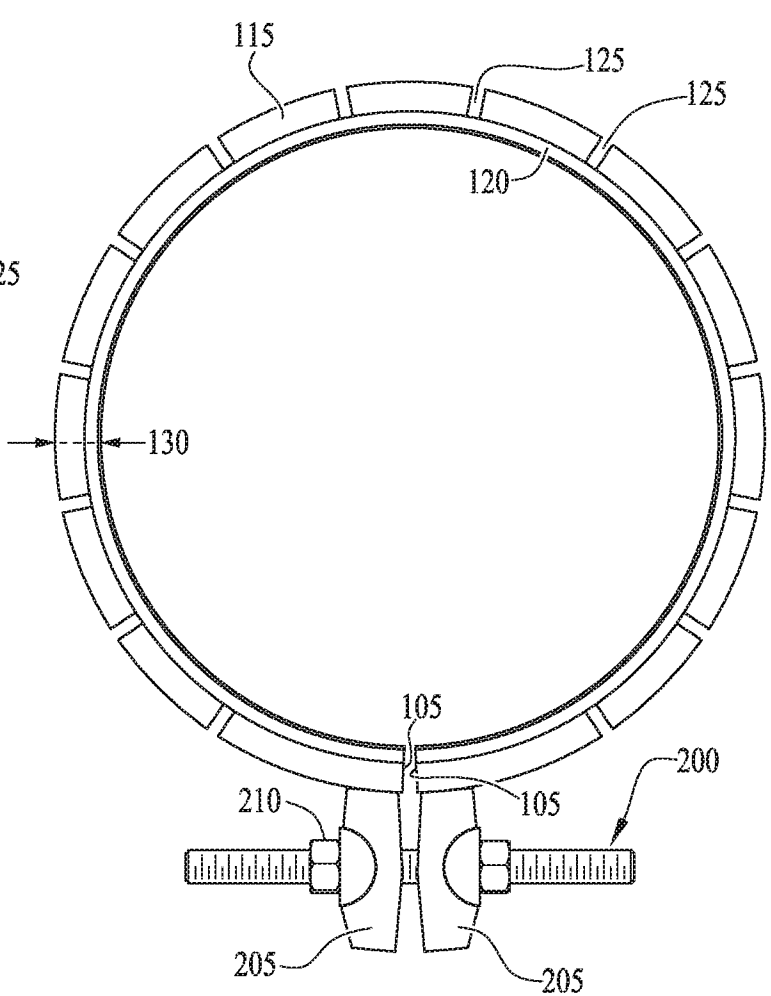
FIG. 2B is a top plan view of a latch ring of an illustrative embodiment in an exemplary compressed position with a pre-installation compression tool fitted.
Figure 2A:
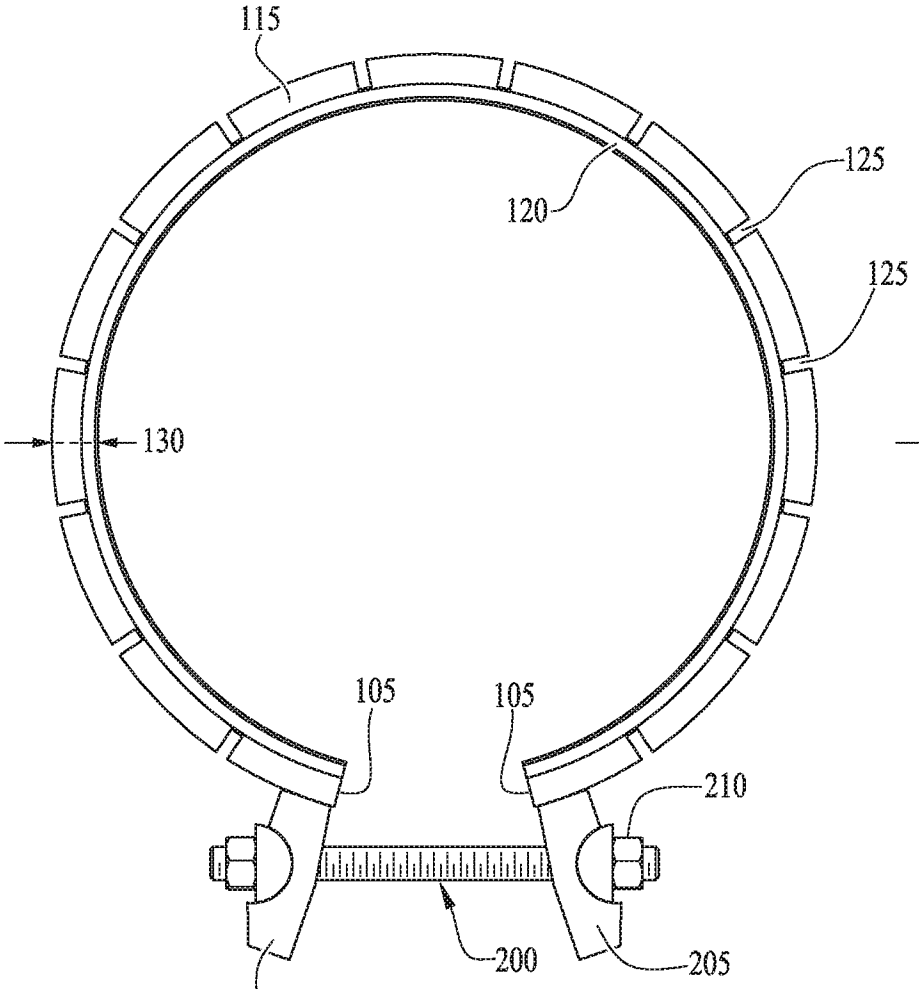
FIG. 2A is a top plan view of a latch ring of an illustrative embodiment in an exemplary relaxed position with a pre-installation compression tool fitted.

During installation of a wellhead system, latch ring 100 may be installed over threads of a seal support 300 or packoff 400 assembly, and set on a shoulder (seat) of the seal support assembly or packoff assembly. A compression tool may be installed onto latch ring 100 to compress latch ring 100 in place. FIGS. 2A-2B illustrate latch ring 100 with compression tool 200 fitted onto latch ring 100. In FIG. 2A, latch ring 100 is relaxed, and in FIG. 2B, latch ring 100 is collapsed by compression tool 200. When compressed either by compression tool 200 or a running tool, ends 105 of latch ring 100 may be brought close together, ends 105 may touch and/or the diameter of latch ring 100 may be decreased. Compression tool 200 may be coupled to latch ring 100 by installing pins of pin block 205 into apertures 110 of latch ring 100. Latch ring 100 may then be compressed by tightening nuts 210 until the outer diameter of latch ring 100 is flush with the outer diameter of the shoulder of seal support 300 (shown in FIG. 3) or packoff 400 (shown in FIG. 4).

Figure 4:
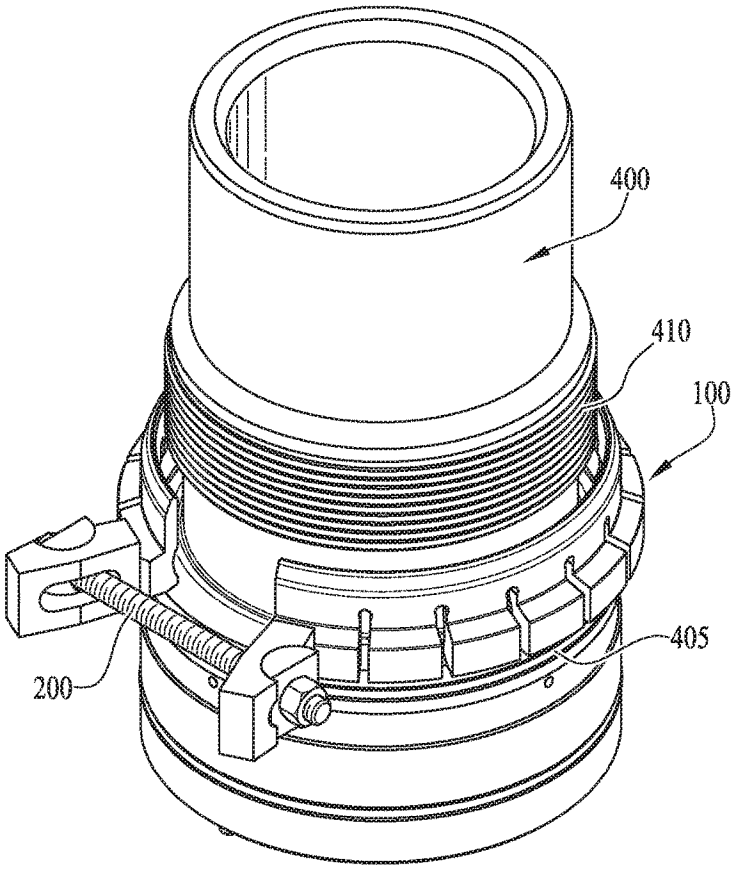
FIG. 4 is a perspective view of a latch ring of an illustrative embodiment in a relaxed position, with pre-installation compression tool fitted, and installed around a packoff assembly of an illustrative embodiment.
Figure 3:
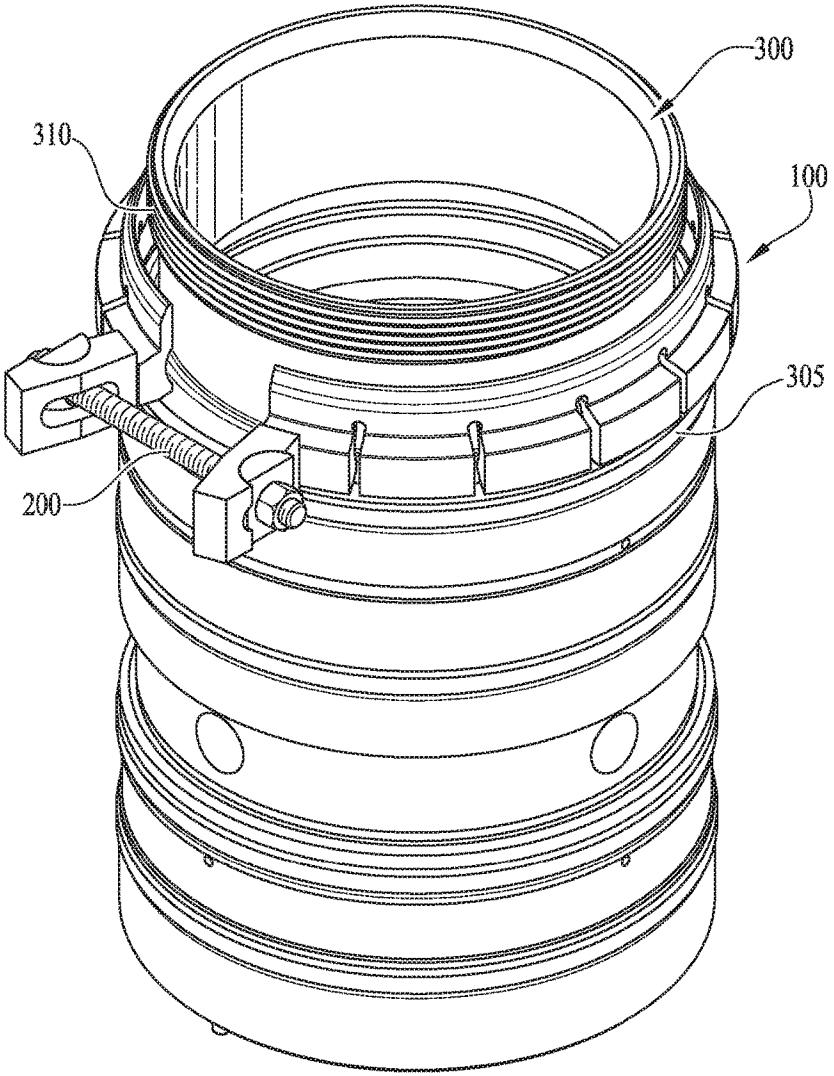
FIG. 3 is a perspective view of latch ring of an illustrative embodiment in a relaxed position, with pre-installation compression tool fitted, and installed around a seal support assembly of an illustrative embodiment.

FIG. 3 illustrates latch ring 100 seated on seal support 300 in a relaxed state. In a relaxed state, latch ring 100 my slide over seal support threads 310 and seat on seal support shoulder 305. Latch ring 100 may seat on shoulder 305 of seal support 300, below seal support threads 310. Once in place on seal support shoulder 305, compression tool 200 may compress latch ring 100 until the outer diameter of latch ring 100 lies flush with the outer diameter of seal support shoulder 305. FIG. 4 illustrates latch ring 100 installed on packoff 400. As shown in FIG. 4, latch ring 100 sits on packoff shoulder 405 of packoff 400, below packoff threads 410. Compression tool 200 may compress latch ring 100 so that the outer diameter of latch ring 100 lies flush against the outer diameter of packoff shoulder 405, which packoff shoulder 405 may form a seat for latch ring 100.

Figure 5:
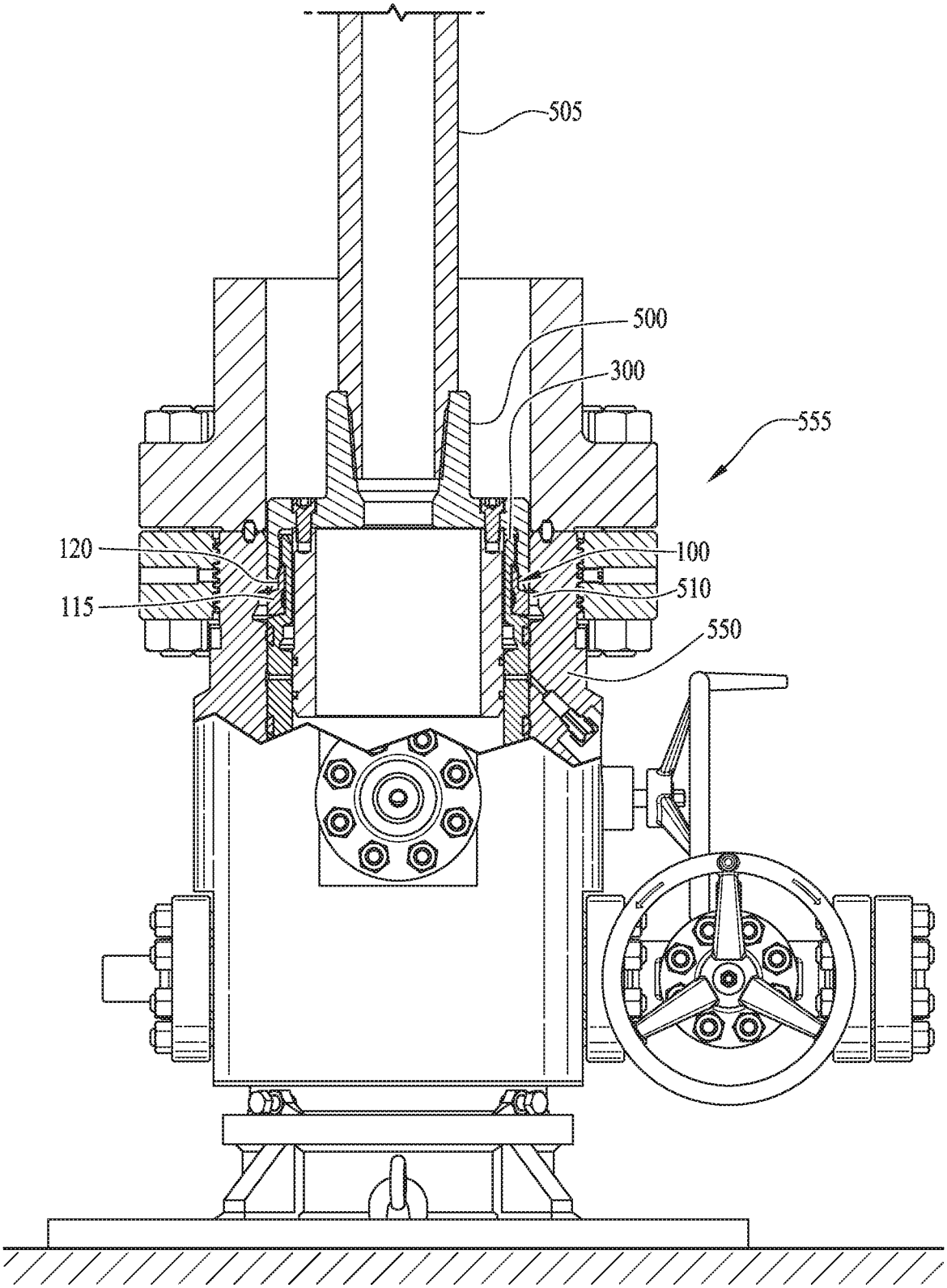
FIG. 5 is a perspective view with part broken away of a wellhead of an illustrative embodiment during landing of an exemplary seal support.
Figure 6:
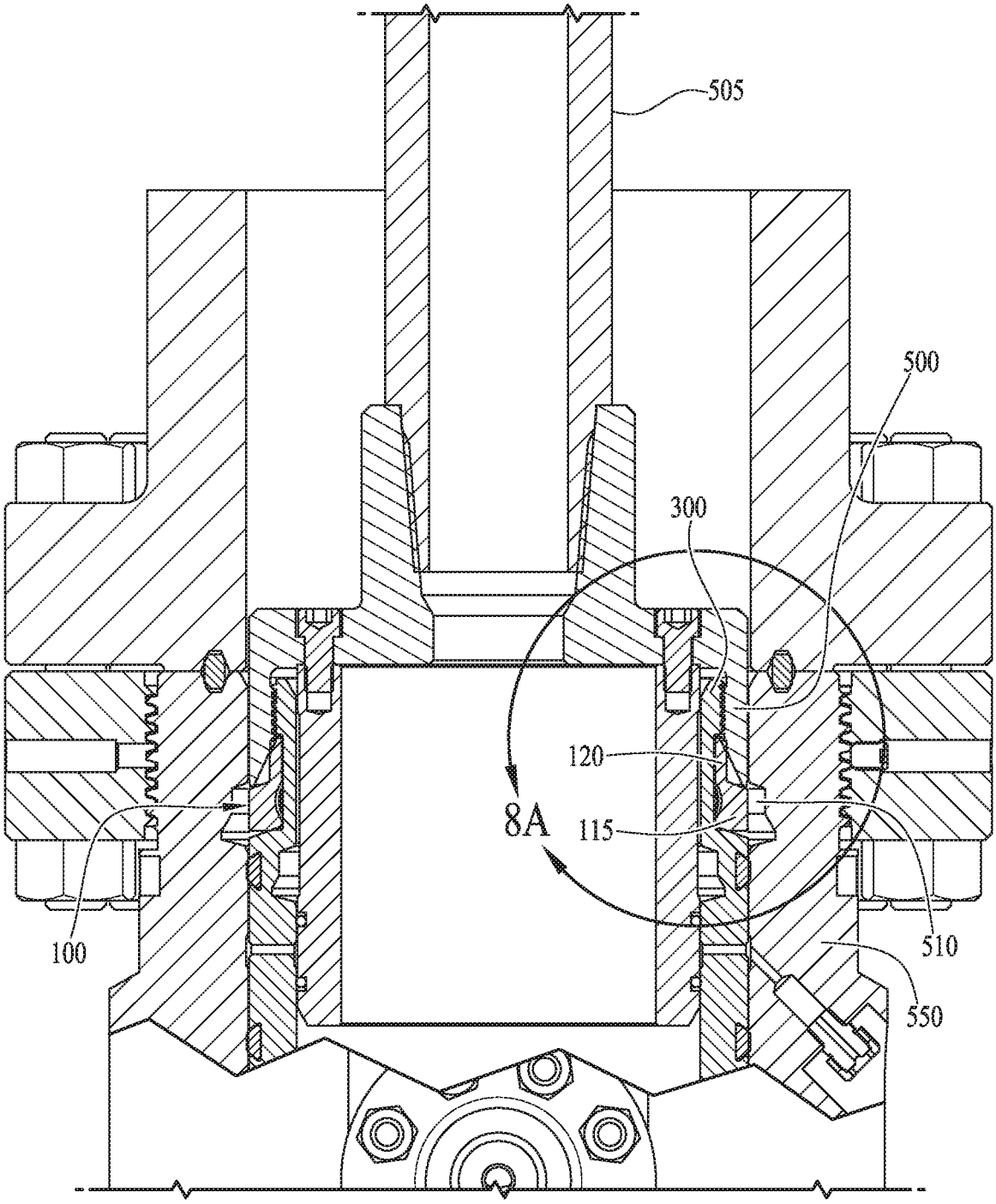
FIG. 6 is a front elevation view with part broken away of an exemplary seal support with seated latch ring of an illustrative embodiment set in position in an exemplary casing head.

FIG. 5 and FIG. 6 illustrate a wellhead of an illustrative embodiment. As shown in FIG. 6, seal support 300 with seated latch ring 100 has landed in casing head 550 of wellhead 555. Latch ring 100 is shown compressed by running tool 500, and in position opposite internal wellhead recess 510 in casing head 550. Internal wellhead recess 510 may extend circumferentially around the inner diameter of casing head 550 and may be similar in depth and size to load retention section 115, such that when compression on latch ring 100 is removed and/or latch ring 100 is relaxed, load retention section 115 mates with internal wellhead recess 510.

Figure 7:
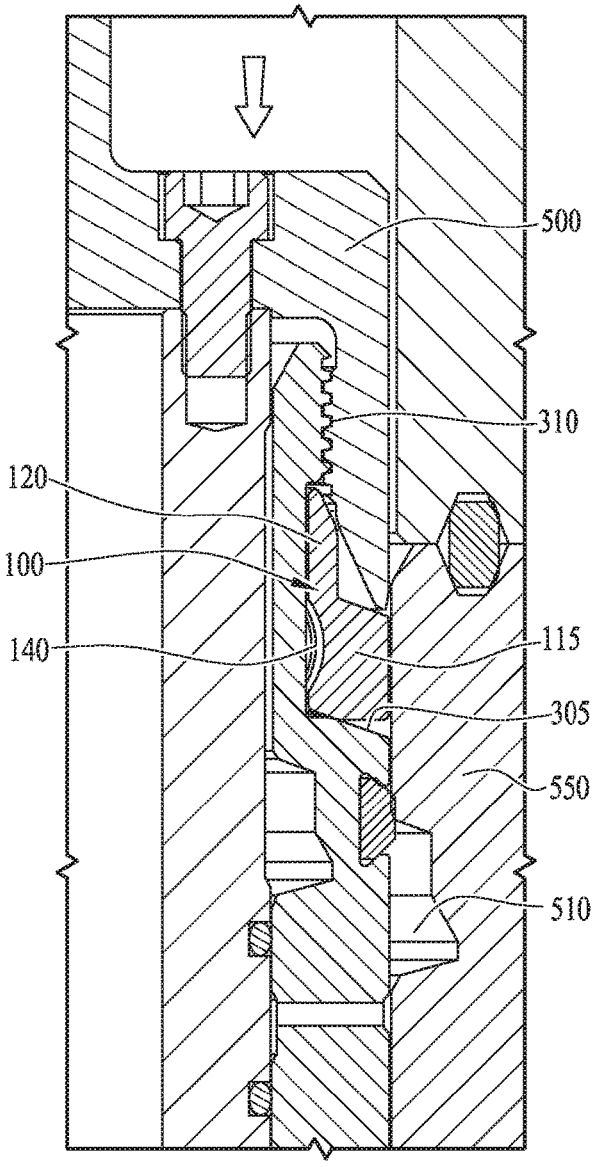
FIG. 7 is a cross sectional view of a compressed latch ring seated on a seal support being lowered to align with an internal wellhead groove.

Latch ring 100 may be secured onto running tool 500 prior to landing seal support 300. Once drill pipe 505 is mated to running tool 500, seal support 300 with latch ring 100 may be secured onto running tool 500 by manually rotating seal support assembly 300 counterclockwise until running tool 500 fully captures running tool brace portion 120 of latch ring 100. Once running tool 500 has captured latch ring 100, compression tool 200 may be removed. Seal support 300 may then be lowered until it is seated on casing hanger mandrel load surface, and latch ring 100 is aligned with internal wellhead recess 510 in casing head 550. FIG. 7 illustrates seal support 300 with seated latch ring 100, compressed by running tool 500, being lowered into wellhead 555 to land on the casing hanger.

Figure 8A:
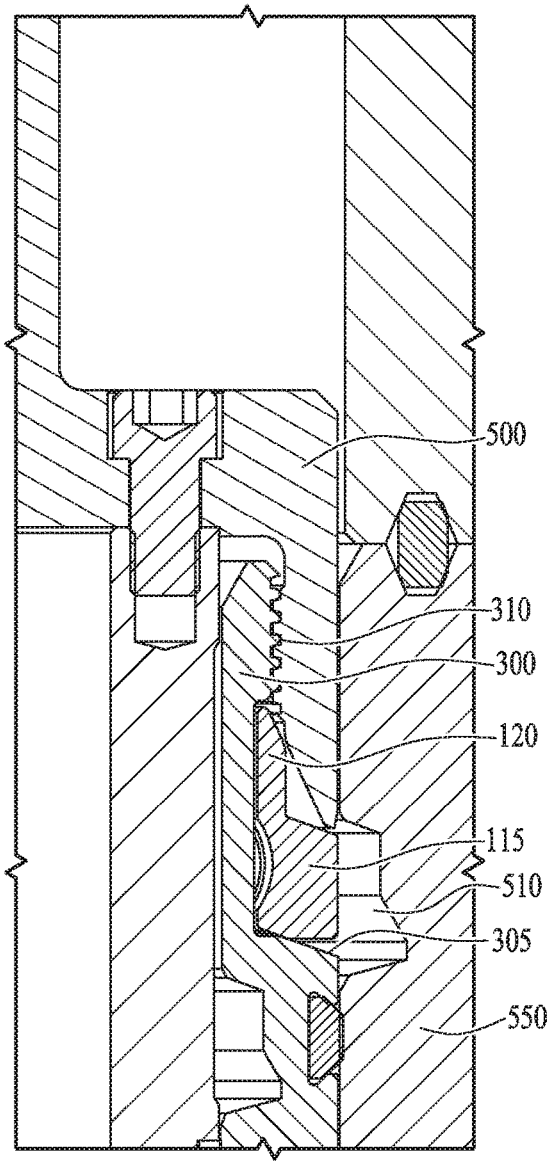
FIG. 8A is an enlarged cross sectional view of the latch ring of FIG. 6 set in position opposite an internal wellhead groove.
Figure 8B:
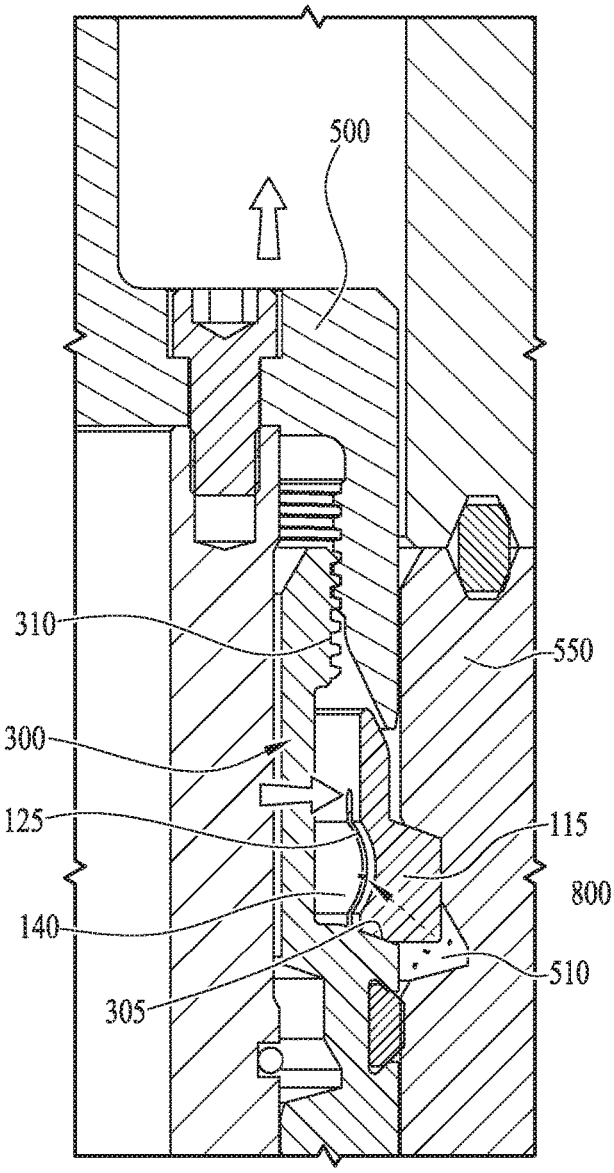
FIG. 8B is a cross sectional view of a latch ring of illustrative embodiments engaging into an exemplary internal wellhead groove as an exemplary running tool is removed.
Figure 8C:
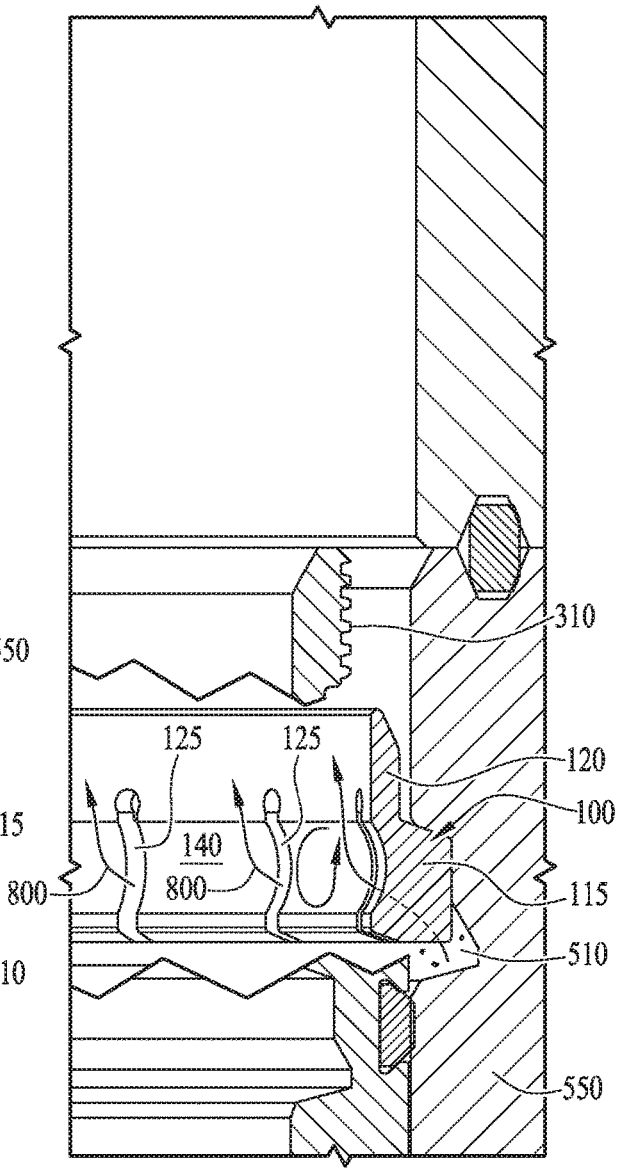
FIG. 8C is a cross sectional view of a latch ring of an illustrative embodiment engaged in an exemplary internal wellhead groove.

FIGS. 8A-8C illustrate setting and engagement of latch ring 100. FIG. 8A illustrates seal support 300 set on casing hanger mandrel load surface and/or load retention section 115 aligned with internal wellhead recess 510 in casing head 550. Once latch ring 100 is properly aligned, running tool 500 may be pulled out and latch ring 100 may expand into internal wellhead recess 510 in casing head 550, such that axial load retention section 115 engages into recess 510 and/or secures latch ring 100. FIG. 8B illustrates running tool 500 being removed upward, and latch ring 100 engaging into internal wellhead recess 510. Upon removal of running tool 500, latch ring 100 may relax and load retention section 115 of latch ring 100 may expand outward to engage into internal wellhead recess 510. As latch ring 100 expands, debris may be flushed inwardly out of internal wellhead recess 510 through pathways 800 formed by slots 125 and/or groove 140. FIG. 8C illustrates latch ring 100 engaged into internal wellhead recess 510, which may provide protection for seal support 300 against upward axial loads. As shown in FIG. 8C, slots 125 and/or groove 140 may provide one or more pathways 800 for continued debris removal should latch ring 100 need to be removed after installation.

Those of skill in the art may appreciate that latch ring 100 may be equally employed in a similar fashion to provide thrust protection to emergency seal supports 300 in casing head 550, on upper packoffs 400 in the seal support assembly 300 and/or on packoffs 400 for non-automatic casing slips. For example, non-emergency seal support 300 may be configured to land on and seal around the casing mandrel, whereas an emergency seal support 300 may be configured to land on casing slips and seal around the casing suspended by those slips. Seal supports 300 and emergency seal supports 300 may differ in the internal sealing arrangement at their lower ends and an "emergency" seal support may be somewhat shorter in overall height as compared to a seal support that is not "emergency". In the art, the term "emergency" is used to refer to a slip type casing hanger that permits suspension of the casing at any point, even if the mandrel type casing hanger cannot be fully seated in the wellhead housing due to casing binding in the wellbore. Latch ring 100 may be employed equally on seal supports 300 and/or emergency seal supports 300.

Figure 9A:
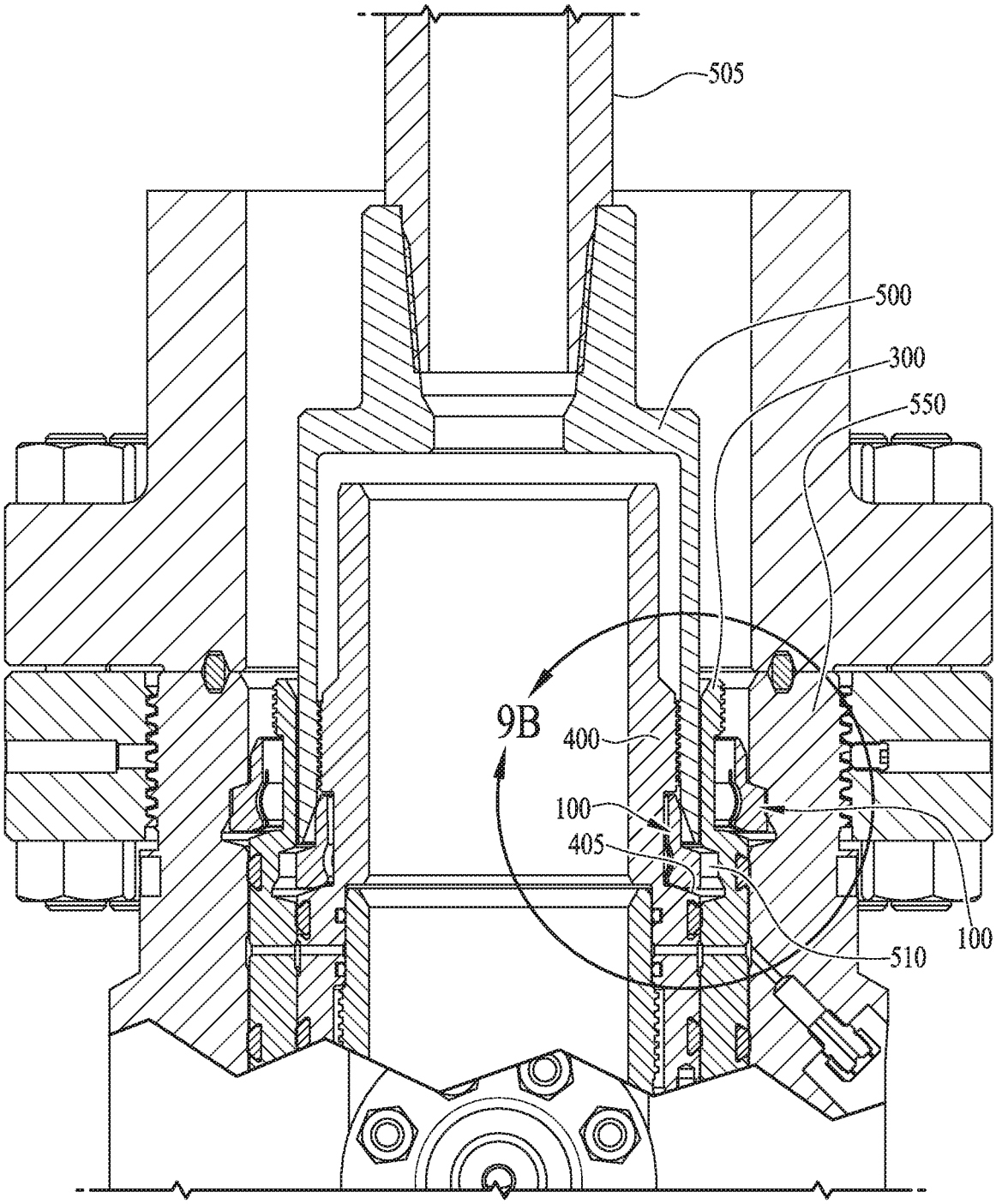
FIG. 9A is a front elevation view with part broken away of a first latch ring of an illustrative embodiment seated around an exemplary packoff and set in position in an exemplary seal support and a second latch ring of an illustrative embodiment around the exemplary seal support and engaged with an exemplary casing head.
Figure 9B:
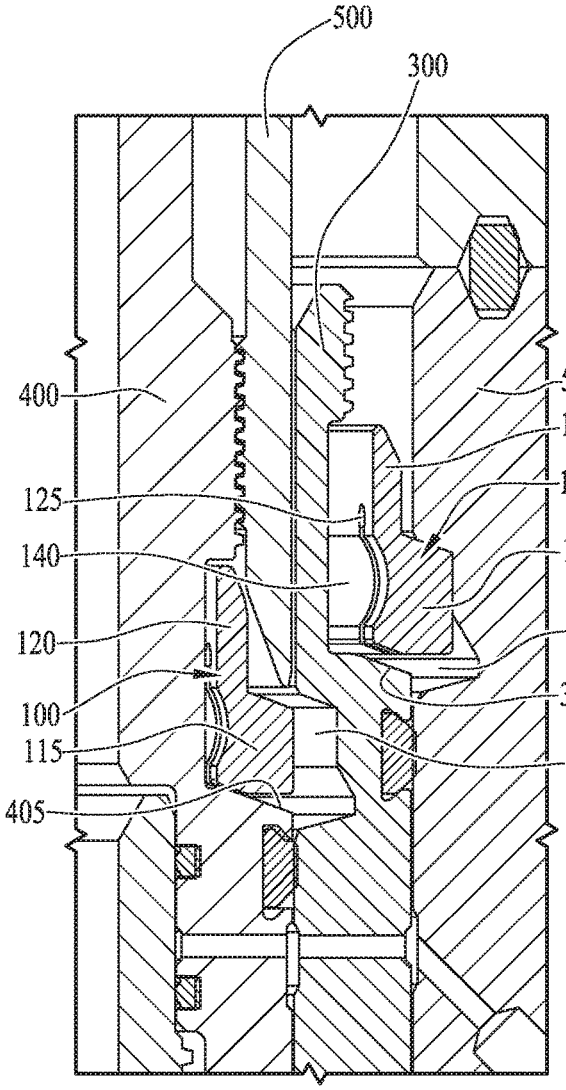
FIG. 9B is an enlarged cross sectional view of the first latch ring and second latch ring of FIG. 9A.
Figure 10:
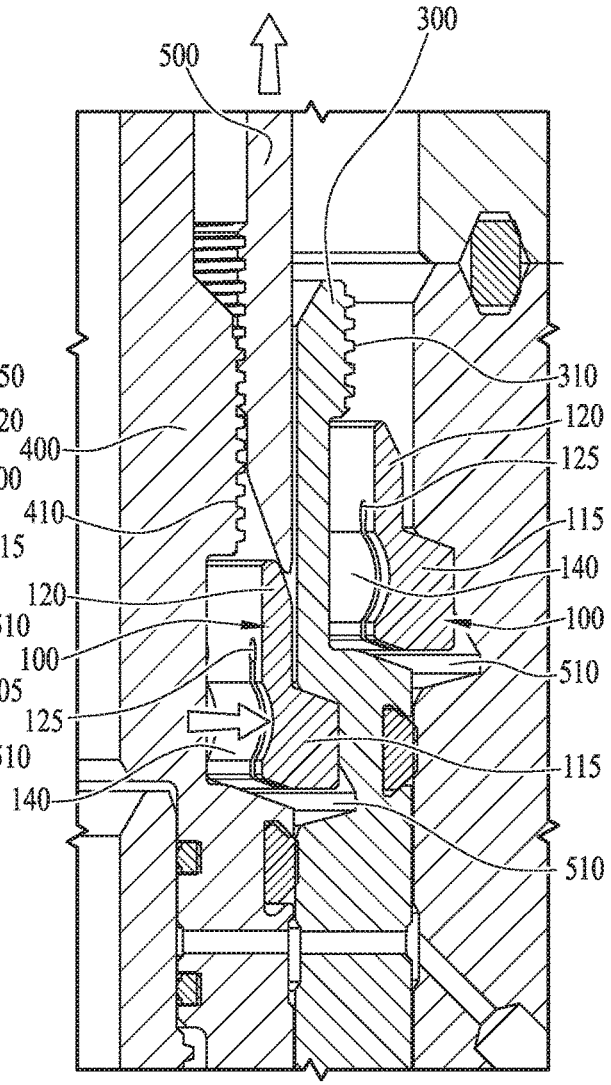
FIG. 10 is a cross sectional view of a pair of internal latch rings of an illustrative embodiment engaged within a wellhead.

Multiple latch rings 100 may be employed in a single wellhead 555. FIGS. 9A-10 illustrate a first latch ring 100 secured around seal support 300 and engaged in casing head 550, and a second latch ring 100 being installed around packoff 400 to engage into an internal wellhead recess 510 extending in and around seal support 300. FIG. 9A-9B illustrate a second latch ring 100 aligned with internal wellhead groove 510 in seal support 300. Running tool 500 is shown bracing running tool brace portion 120 of second latch ring 100 to hold second latch ring 100 in compression. In FIG. 10, running tool 500 is being removed, and second latch ring 100 is shown engaging into internal wellhead groove 510 in seal support 300. Thus in FIG. 10, two latch rings 100 are shown engaged, a first latch ring 100 that may counteract axial loads exerted on seal support 300, and a second latch ring 100 may counteract axial loads exerted on packoff 400.

A wellhead internal latch ring apparatus, system and method has been described. Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the scope and range of equivalents as described in the following claims. In addition, it is to be understood that features described herein independently may, in certain embodiments, be combined.

What is claimed is:

1. An improved wellhead internal latch ring comprising:

an annular running tool brace portion;

an annular load retention portion coupled below the annular running tool brace portion, the annular load retention portion stepped outward from a bottom of the annular running tool brace portion; and a plurality of slots dispersed around the load retention portion, each slot of the plurality of slots extending axially through at least a portion of the annular load retention portion;

wherein the annular load retention portion and the running tool brace portion form a c-shaped ring.

2. The improved wellhead internal latch ring of claim 1, further comprising a circumferential groove extending around an inner diameter of the annular load retention portion, the circumferential groove fluidly coupled to the plurality of slots.

3. The improved wellhead internal latch ring of claim 2, wherein the circumferential groove forms a curved relief and intersects the plurality of slots.

4. The improved wellhead internal latch ring of claim 1, wherein the plurality of slots form a plurality of pathways between an outer diameter of the annular load retention portion and the inner diameter of the annular load retention portion.

5. The improved wellhead internal latch ring of claim 1, wherein the annular load retention portion is mechanically actuatable between a compressed position and a relaxed position.

6. The improved wellhead internal latch ring of claim 1, wherein each slot of the plurality of slots extends axially from a bottom of the annular load retention portion, through the annular load retention portion and at least partially into the running tool brace portion.

7. The improved wellhead internal latch ring of claim 1, wherein the plurality of slots comprise an elasticizing array spaced around the load retention portion from end-to-end of the c-shaped ring.

* * * * *